US010132097B2

(12) United States Patent
Herfurth et al.

(10) Patent No.: US 10,132,097 B2
(45) Date of Patent: Nov. 20, 2018

(54) BREAKAGE-RESISTANT COMPOSITE MATERIAL AND STUD WALL, ROOF OR CEILING STRUCTURE

(71) Applicant: Knauf Gips KG, Iphofen (DE)

(72) Inventors: Dominik Herfurth, Iphofen (DE); Michael Viebahn, Iphofen (DE)

(73) Assignee: Knauf Gips KG, Iphofen (DE)

( * ) Notice: Subject to any disclaimer, the term of this patent is extended or adjusted under 35 U.S.C. 154(b) by 0 days.

(21) Appl. No.: 15/031,331

(22) PCT Filed: Oct. 24, 2013

(86) PCT No.: PCT/EP2013/072275
§ 371 (c)(1),
(2) Date: Apr. 22, 2016

(87) PCT Pub. No.: WO2015/058800
PCT Pub. Date: Apr. 30, 2015

(65) Prior Publication Data

US 2016/0258176 A1 Sep. 8, 2016

(51) Int. Cl.
*E04H 9/16* (2006.01)
*E04B 2/16* (2006.01)
(Continued)

(52) U.S. Cl.
CPC ..... *E04H 9/16* (2013.01); *E04B 1/24* (2013.01); *E04B 2/16* (2013.01); *E04B 2/56* (2013.01);
(Continued)

(58) Field of Classification Search
CPC ..... E04H 9/16; E04C 2/50; E04C 2/46; E04C 2/34; E04C 2/26; E04B 2/56; E04B 2/16;
(Continued)

(56) References Cited

U.S. PATENT DOCUMENTS 3,488,904 A * 1/1970 Dawdy ..... E04B 2/7401 428/457
4,265,964 A * 5/1981 Burkhart ..... C04B 28/14 423/171
(Continued)

FOREIGN PATENT DOCUMENTS

DE 9316000 U1 * 1/1994 ..... B32B 13/04
DE 29622165 U1 2/1997
(Continued)

OTHER PUBLICATIONS

"Feb. 2008—wwww.multigips.com | Multi Gips | Solid dry wall construction with Gypsim Block" retrieved at http://web.archive.org/web/20170207165135/http://www.multigips.com/data/mg_wb_uk.pdf retrieved on Feb. 7, 2017.*
(Continued)

*Primary Examiner* — Charles A Fox
*Assistant Examiner* — Joseph J. Sadlon
(74) *Attorney, Agent, or Firm* — The Webb Law Firm

(57) ABSTRACT

The present invention relates to a breakage-resistant composite composed of several superposed layers, particularly as planking for a stud wall, roof or ceiling structure, wherein the composite comprises at least one first gypsum board panel in the form of a paperbound gypsum board panel, at least one metal sheet arranged on the first gypsum board panel, and at least one second gypsum board panel in the form of a gypsum fiberboard panel arranged on the metal sheet.

26 Claims, 5 Drawing Sheets

(51) Int. Cl.

| | |
|---|---|
| ***E04B 2/56*** | (2006.01) |
| ***E04C 2/26*** | (2006.01) |
| ***E04C 2/34*** | (2006.01) |
| ***E04B 2/00*** | (2006.01) |
| ***E04B 5/02*** | (2006.01) |
| ***E04B 1/24*** | (2006.01) |
| ***E04B 2/74*** | (2006.01) |

(52) U.S. Cl.
CPC ..... *E04B 2/7457* (2013.01); *E04C 2/26* (2013.01); *E04C 2/34* (2013.01); *E04C 2/46* (2013.01); *E04C 2/50* (2013.01); *E04B 2001/2481* (2013.01)

(58) Field of Classification Search
CPC ... E04B 2/7457; E04B 1/24; E04B 2001/2481
USPC ..... 52/481.1
See application file for complete search history.

(56) References Cited

U.S. PATENT DOCUMENTS 4,291,513 A * 9/1981 Ankarswed ..... E04C 2/382 52/284
4,327,146 A * 4/1982 White ..... B28B 1/50 156/43
4,328,178 A * 5/1982 Kossatz ..... C04B 20/1055 106/674
4,409,766 A * 10/1983 Blackmore ..... E04B 1/74 52/169.11
4,669,240 A * 6/1987 Amormino ..... E04B 1/04 264/253
4,923,664 A * 5/1990 Kossatz ..... B28B 1/525 264/256
5,245,811 A * 9/1993 Knorr ..... E04B 2/7409 403/382
5,555,689 A * 9/1996 Gilmore ..... E04B 2/7457 52/241
5,722,626 A * 3/1998 Menchetti ..... B65D 57/00 108/53.3
5,740,644 A * 4/1998 Menchetti ..... E04F 17/005 52/281
6,202,377 B1 * 3/2001 Krieger ..... E04F 13/0812 52/489.1
6,481,171 B2 * 11/2002 Yu ..... C04B 28/147 52/443
6,598,362 B2 * 7/2003 Hikai ..... E04F 13/0864 52/235
6,599,621 B2 * 7/2003 Porter ..... B32B 5/18 428/107
7,107,731 B2 * 9/2006 Record ..... E04C 2/288 52/284
7,504,165 B2 * 3/2009 Lettkeman ..... C04B 28/147 106/772
7,900,410 B2 * 3/2011 Skendzic ..... E04B 1/04 52/236.5
8,099,920 B2 * 1/2012 Ito ..... E04F 13/0826 52/239
8,603,927 B2 * 12/2013 Kajander ..... B32B 5/02 162/156
D712,569 S * 9/2014 Lengacher ..... D25/151
8,844,227 B1 * 9/2014 Ciuperca ..... E04C 2/296 52/309.11
9,151,052 B2 * 10/2015 Krause ..... E04F 13/0828
9,493,940 B2 * 11/2016 Collins ..... E04B 1/24
9,689,159 B2 * 6/2017 Bennett ..... B32B 21/06
2004/0209074 A1 10/2004 Randall et al.
2013/0133277 A1 * 5/2013 Lewis ..... E04B 1/7675 52/220.1

FOREIGN PATENT DOCUMENTS

| | | | |
|---|---|---|---|
| DE | 102008045560 | A1 | 2/2010 |
| FR | 2757890 | A1 | 7/1998 |
| RU | 22955 | U1 | 5/2002 |
| RU | 2363822 | | 3/2006 |
| WO | 9530810 | A1 | 11/1995 |

OTHER PUBLICATIONS

USPTO Translation DE 9316000 U1; 12 pages including Figures; provided to Examiner Sep. 19, 2016; original publication Jan. 5, 1994 (Year: 1994).*
Ministry of Regional Development; "The designs with application of gypsum plasterboards and gypsum fiber sheets"; 2012; 104 pp.; Moscow.

* cited by examiner

BREAKAGE-RESISTANT COMPOSITE MATERIAL AND STUD WALL, ROOF OR CEILING STRUCTURE

CROSS-REFERENCE TO RELATED APPLICATION

This application is the United States national phase of International Application No. PCT/EP2013/072275 filed Oct. 24, 2013, the disclosure of which is hereby incorporated in its entirety by reference.

BACKGROUND OF THE INVENTION

Field of the Invention

The invention relates to a breakage-resistant composite material as set forth in claim 1, a stud wall, roof or ceiling structure, and to the use of a breakage-resistant composite and/or a stud wall, roof or ceiling structure.

Description of Related Art

A breakage-resistant composite is known, for example, from DE 10 2008 045 560 A1. A breakage-resistant composite for covering a stud wall, roof or ceiling structure with paneling can be particularly useful in cases in which individual parts of a room or an entire room is to be secured in such a way that a break-in or break-out by one or more people into or out of the room is prevented if possible or at least impeded. Such a breakage-resistant composite can appear expedient for the division of cells in penal institutions or even when modifying the interior of other buildings (such as a bank) in order to prevent, if possible, or impede deliberate penetration by one or more people.

DE 10 2008 045 560 A1 proposes the formation of a composite of several layers that are interconnected by joining means. In particular, a plurality of first joining means, particularly screws, are provided in the region between the assembly points at a distance from one another that are active between a first nonmetal layer and a second metal layer in order to form a first subcomposite and covered by an external nonmetal layer or metal layer. Nails, rivets, staples or crimp elements are also mentioned as alternatives to screws. Adhesion between two adjacent layers is also mentioned. Overall, it is deemed problematic that penetration through the composite of DE 10 2008 045 560 A1 is still relatively easy.

It is the object of the present invention to provide a breakage-resistant composite with which deliberate penetration by one or more people is rendered even more difficult. Moreover, a corresponding stud wall, roof or ceiling structure is proposed.

SUMMARY OF THE INVENTION

This object is achieved by a breakage-resistant composite composed of several superposed layers, particularly in the form of paneling for a stud wall, roof or ceiling structure, the composite comprising at least one first gypsum board panel in the form of a paperbound gypsum board panel, at least one metal sheet arranged on the first gypsum board panel and at least one second gypsum board panel in the form of a gypsum fiberboard panel arranged on the metal sheet. Here and in the following, the term "gypsum board panel" will be used as a generic term for "paperbound gypsum board panel" and "gypsum fiberboard panel."

One core concern of the present invention is to provide a structure with a paperbound gypsum board panel, a metal sheet and a gypsum fiberboard panel. The gypsum fiberboard panel constitutes a first (and difficult-to-overcome) obstacle for a person breaking in or out. This first obstacle can be connected especially effectively to the metal sheet. The metal sheet constitutes a second obstacle. If the person breaking in or out also manages to overcome this obstacle, the paperbound gypsum board panel would still also have to be penetrated. Through the special arrangement of gypsum fiberboard panel/metal sheet/paperbound gypsum board panel, a relatively lightweight composite is realized that is especially difficult to penetrate. The gypsum fiberboard panel acts as a hard protective plate which, by virtue of the composite with the metal sheet and the paperbound gypsum board panel, is especially difficult to penetrate (in comparison to the paperbound gypsum board panel).

Preferably, metal sheet and second gypsum board panel are adhered to one another. The adhesion can particularly occur over the entire surface. Alternatively, however, it is conceivable for the adhesion to be applied at points or in stripes. In any case, an extremely stable composite is achieved through the adhesion, with the metal sheet also being exploited as an adhesion-promoting layer. It is conceivable (alternatively or in addition) to adhere the first gypsum board panel to the metal sheet (over the entire surface or in sections, e.g., at points or in stripes). However, the first gypsum board panel can also be connected to the metal sheet using other joining means (e.g., screws, nails and/or rivets).

According to one development, at least two second (adjacently arranged) gypsum board panels are provided. Preferably, the at least two second gypsum board panels are adhered to one another at their adjacent edge surfaces. As a result, the stability of the composite is further improved. Overall, a composite system can be achieved that is very difficult to penetrate.

The abovementioned object is also achieved by a breakage-resistant composite, particularly of the abovementioned type, that is composed of several superposed layers, particularly as paneling of a stud wall, roof or ceiling structure, the composite comprising at least one first gypsum board panel, particularly in the form of a paperbound gypsum board panel, at least one metal sheet arranged on the first gypsum board panel, and at least two adjacently arranged second gypsum board panels arranged on the metal sheet, particularly in the form of gypsum fiberboard paneling, the at least two adjacently arranged second gypsum board panels being adhered to the metal sheet and to each other at their adjacent edge surfaces. Through the adhesion of the second gypsum board panel to the metal sheet on the one hand and to a respective adjacent second gypsum board panel on the other hand, an extremely stable composite is achieved that offers practically no starting points for penetration.

In one specific embodiment, a provision can be made that at least two first or second gypsum board panels form a joint between them and at least one second gypsum board panel extends over the joint. Alternatively or in addition, a provision can be made that at least two first or second gypsum board panels form a joint between them and at least one first gypsum board panel extends over the joint. A general concept is therefore that any joints be arranged in an offset manner. As a result, penetration of the overall composite is rendered even more difficult, for example if a person breaking in or out applies a tool to the joint.

The at least one first gypsum board panel can have an impregnated gypsum core. Moreover (alternatively or in addition), the at least one first gypsum board panel can have a density (raw density) of ≥500 kg/m$^3$, particularly ≥1,000 kg/m$^3$. Alternatively or in addition, maximum limits can be 2,000 kg/m$^3$, particularly 1,500 kg/m$^3$. Alternatively or in addition, the density is preferably ≥5 mm, more preferably ≥10 mm, even more preferably (about) equal to 12.5 mm and/or ≥40 mm, preferably ≥30 mm, even more preferably ≥20 mm. The at least one second gypsum board panel can have a density (raw density) of preferably ≥800 kg/m$^3$, more preferably 1,500 kg/m$^3$. A maximum limit can, for example, be ≤3,000 kg/m$^3$, more preferably 2,000 kg/m$^3$. The thickness of the second gypsum board panel can preferably be ≥20 mm, even more preferably ≥28 mm and/or ≤50 mm, preferably ≤40 mm.

A density (raw density) of the at least one second gypsum board panel is preferably greater than a density (raw density) of the at least one first gypsum board panel. For example, the density (raw density) of the at least one second gypsum board panel can be at least 1.2, preferably at least 1.5, even more preferably at least 1.8 times as high as the density of the at least one first gypsum board panel. The thickness of the at least one second gypsum board panel can be greater than the thickness of the at least one first gypsum board panel. In particular, the thickness of the at least one second gypsum board panel can be at least 1.2, preferably at least 1.5, even more preferably at least 2 times as large as a thickness of the at least one first gypsum board panel. Through such dimensioning of the first and second gypsum board panels, it is achieved that the second gypsum board panel acts as a (relatively heavy) protective plate that is further supported by the inherently already difficult-to-penetrate metal sheet and the paperbound gypsum board panel. For one, penetration is thus rendered difficult. For another, the overall composite is relatively lightweight, considering the intended application.

The metal sheet can be a (particularly galvanized) steel sheet. Alternatively or in addition, the metal sheet can have a thickness of ≥0.3 mm, preferably ≥0.5 mm and/or 1 mm, preferably 0.8 mm. Preferably, the metal sheet is thinner than the at least one first gypsum board panel and/or the at least [one] second gypsum board panel. Also preferably, the metal sheet is thinner than the first gypsum board panel and/or the second gypsum board panel by a factor of 4, more preferably by a factor of at least 10, even more preferably by a factor of at least 25. A relatively thin metal sheet is thus proposed quite consciously. The stabilizing characteristics of such a thin metal sheet and, in particularly, its characteristic as an adhesion substrate for the at least one second gypsum board panel are thus exploited synergistically without substantially increasing the overall weight.

The adhesive for adhering at least one second gypsum board panel to the at least one metal sheet can be an elastic adhesive (particularly an elastic tile adhesive). As a result, a reliably holding and difficult-to-penetrate composite is created. Alternatively or in addition, an adhesive for adhering adjacent contact surfaces of two second gypsum board panels can be a joint adhesive, particularly a polyurethane-based one. With such a joint adhesive, the second gypsum board panels can be fastened together in an especially stable manner, whereby an almost monolithic overall composite is achieved overall.

The abovementioned object is also achieved by a stud wall, roof or ceiling structure comprising at least one supporting means (substructure), particularly at least one profile element (such as a U, C or M profile, for example), at least one breakage-resistant composite as set forth in any one of the preceding claims being arranged on a first side of the supporting means (substructure), and the at least one first gypsum board panel of the breakage-resistant composite facing toward the supporting means (substructure). By virtue of such a structure and such a construction, especially reliable protection of the supporting means (substructure) is ensured. The second gypsum board panel acts here as a protective plate that is supported by additional, difficult-to-penetrate layers. Overall, a high degree of break-in and break-out security is achieved.

Preferably, at least one additional breakage-resistant composite of the abovementioned type is arranged on the second side of the supporting means (substructure), at least one first gypsum board panel of the at least one additional breakage-resistant composite preferably facing toward the supporting means (substructure). Overall, a sandwich is realized in which the supporting means (substructure) is arranged between two breakage-resistant composites (or the abovementioned type). Such a sandwich is very difficult to penetrate.

According to the invention, in order to achieve the abovementioned object, the use of a breakage-resistant composite of the type described above and/or of a stud wall, roof or ceiling structure of the type described above is proposed for and as security against the breaking-in or breaking-out of a person.

All in all, an extremely reliable breakage-resistant wall structure is enabled by the present invention. In one certification process, the breakage-resistant wall structure was classified as class B according to VdS 2534. This was the first time a breakage-resistant drywall structure achieved this classification. At the same time, ballistic class FB4 NS according to DIN EN 1522 was achieved. All of this was achieved by a mechanically very strong composite with a relatively lightweight (when considering the intended application) and cost-effective structure.

Additional embodiments are disclosed and claimed herein.

BRIEF DESCRIPTION OF THE DRAWINGS

The invention is described below with respect to additional features and advantages on the basis of exemplary embodiments, which are explained in further detail with reference to the figures.

DETAILED DESCRIPTION OF THE INVENTION

In the following description, the same reference symbols are used for same and similarly functioning elements.

Figure 1:
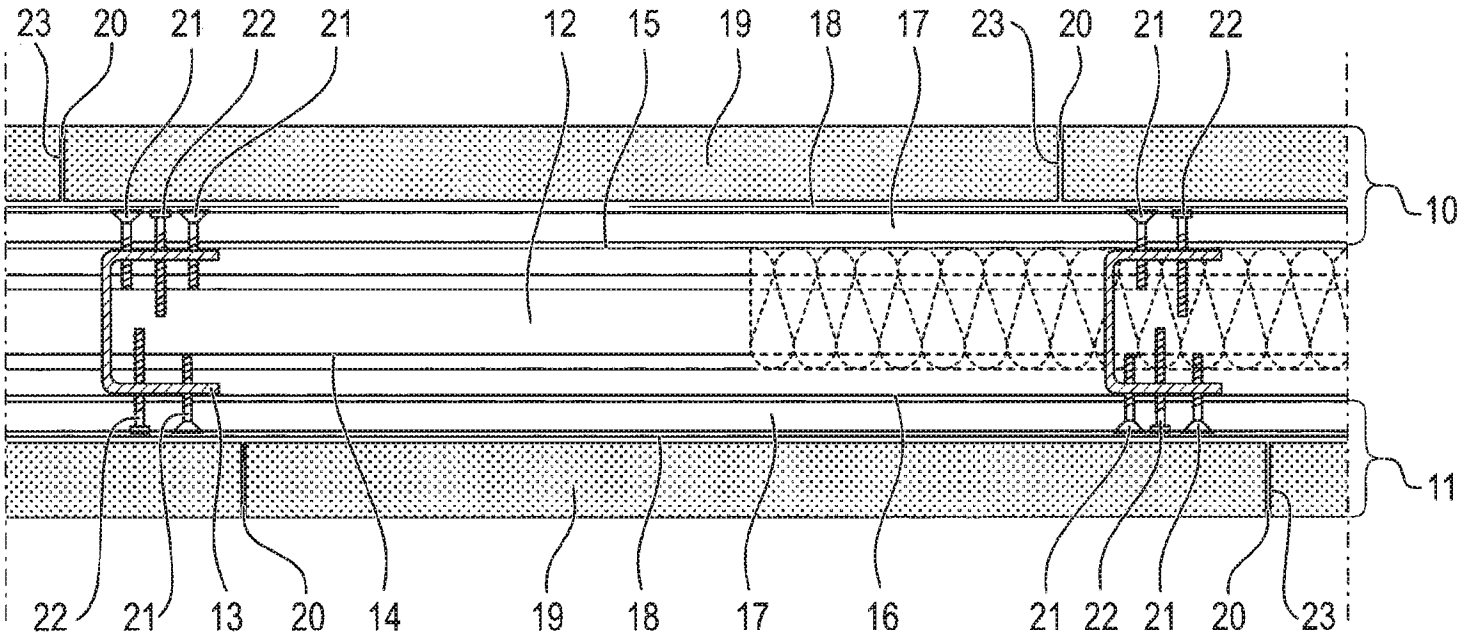
FIG. 1 shows a first cutaway of a horizontal section of a wall structure with the breakage-resistant composite according to the invention.

FIG. 1 shows a cutaway of a horizontal section of a wall structure with a first breakage-resistant composite 10 and a second breakage-resistant composite 11. The breakage-resistant composites 10, 11 are each arranged on a side of a supporting means (substructure) 12. The supporting means (substructure) 12 comprises first (U-shaped) profile elements 13 as well as second (U-shaped) profile elements 14. First profile elements 13 and second profile elements 14 are arranged perpendicular to one another. The first breakage-resistant composite is arranged on a first side 15 (the upper side in FIG. 1). The second breakage-resistant composite 11 is arranged on a second side 16 (the lower side in FIG. 1) of the supporting means (substructure) 12. One or more first gypsum board panels 17 are facing toward the supporting means (substructure) 12. One or more metal sheets 18 are respectively arranged on the gypsum board panels 17. Second gypsum board panels 19 are arranged on the metal sheets 18. The second gypsum board panels 19 are facing away from the supporting means (substructure) 17 (and are thus arranged on the outside).

The first gypsum board panels 17 are embodied as paper-bound gypsum board panels. The second gypsum board panels 19 are embodied as gypsum fiberboard panels. Joints 20 are respectively formed between the second gypsum board panels 19 of the first breakage-resistant composite 10 and the gypsum board panels 19 of the second breakage-resistant composite 11. Both the first gypsum board panels 17 of the first breakage-resistant composite 10 and the first gypsum board panels of the second breakage-resistant composite 11 and the second gypsum board panels 19 of the second breakage-resistant composite extend over the joints of the second gypsum board panels 19 of the first breakage-resistant composite (and vice versa).

The first gypsum board panels 17 are fastened to the supporting means (substructure) 12 by means of fastening means (joining means) 21 (e.g., screws). These fastening means (joining means) penetrate through only the first gypsum board panels 17 and the supporting means (substructure) 12 (or the first profile elements 13 thereof). Additional fastening means 22 (screws) penetrate through the metal sheet 18 as well as the respectively associated first gypsum board panel 17 and the supporting means (substructure) 12 (or the first profile elements 13 thereof). Both the metal sheet 18 and the first gypsum board panel 17 are thus fastened by the fastening means 22 to the supporting means (substructure) 12. At the same time, the metal sheet 18 covers the fastening means 21. This renders it even more difficult to break through.

Both the fastening means 21 and the fastening means 22 are covered by (one each, or optionally more) second gypsum board panels 19. The second gypsum board panels 19 are adhered to the respective metal sheet 18 (e.g., by means of an elastic tile adhesive). The joints 20 are adhered by a polyurethane adhesive. Edge surfaces 23 of the second gypsum board panels 19 are thus adhered to one another.

Figure 2:
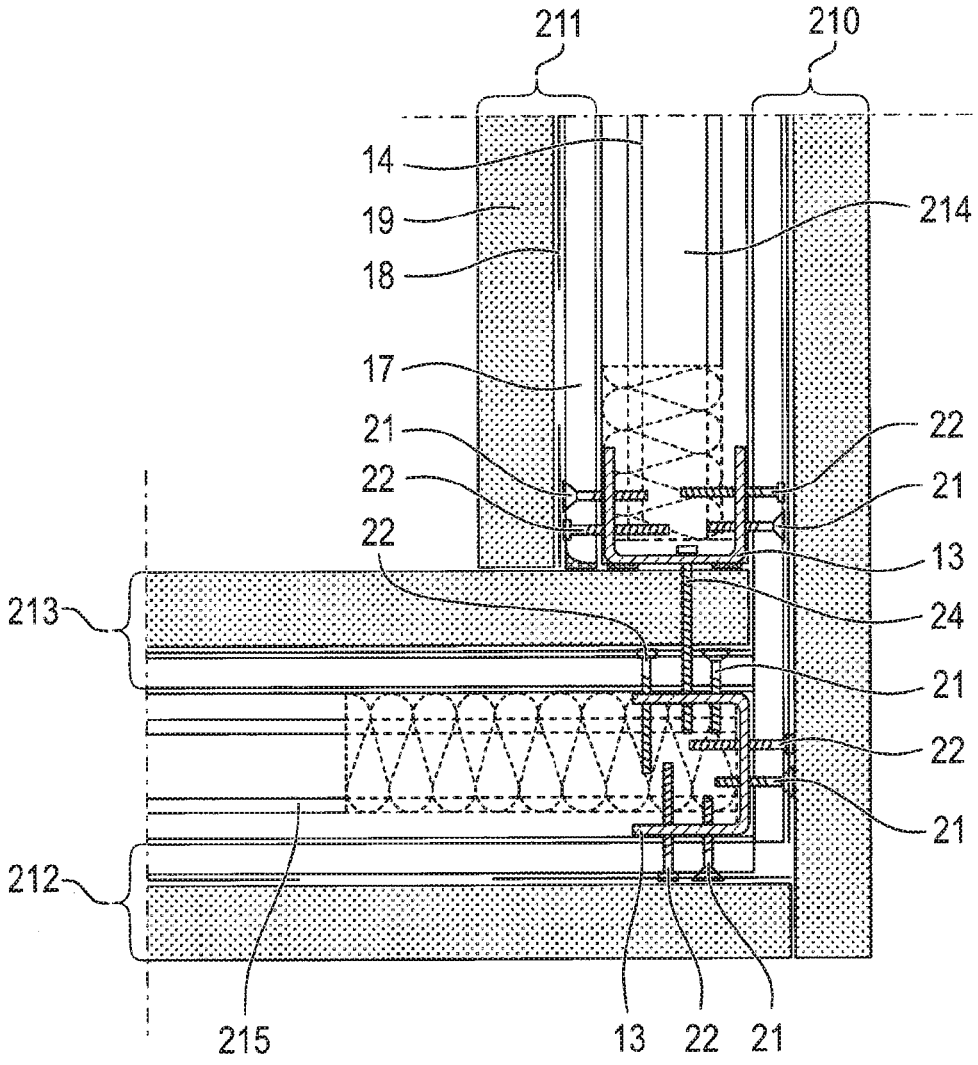
FIG. 2 shows a second cutaway of a horizontal section of a wall structure with the composite according to the invention.

FIG. 2 shows a second cutaway of a horizontal section of a wall structure with breakage-resistant composites according to the invention. With the construction illustrated in FIG. 2, a corner can be realized between two walls, for example. A total of four breakage-resistant composites are provided, namely a first breakage-resistant composite 210, a second breakage-resistant composite 211, a third breakage-resistant composite 212 and a fourth breakage-resistant composite 213. The breakage-resistant composites 210, 211, 212 and 213 each comprise (at least) one first gypsum board panel 19 (at least) one metal sheet 18 and (at least) one second gypsum board panel 19.

First and second breakage-resistant composites 210, 211 cover the sides of a first supporting means (substructure) 214. Second and third breakage-resistant composites 212, 213 cover the sides of a second supporting means (substructure) 215. The supporting means (substructures) 214, 215 are structured like the supporting means (substructure) 12 in FIG. 1.

The first breakage-resistant composite 210 covers a front face of the third and fourth breakage-resistant composite 212, 213 as well as of the second supporting means (substructure) 215. Specifically, a second gypsum board panel 19 of the first breakage-resistant composite 210 covers front faces of the first and second gypsum board panels 17, 19 of the metal sheets 18 of the third and fourth breakage-resistant composite 212, 213 as well as the second supporting means (substructure) 215 arranged therebetween. The metal sheet 18 and a first gypsum board panel 17 of the first breakage-resistant composite 210 cover the front edges of the gypsum board panels 17, 19 of the fourth breakage-resistant composite 14 as well as a front edge of the supporting means (substructure) 215 as well as a front edge of the first gypsum board panel 17 of the breakage-resistant composite 212, but not a front edge of the metal sheet 18 and of the second gypsum board panel 19 of the third breakage-resistant composite 212. As a result, the second gypsum board panel 19 and the first gypsum board panel 17 of the first breakage-resistant composite 210 form a step-like configuration that is especially difficult to be broken through by a person breaking in or out. A first profile element 13 of the first supporting means (substructure) 214 is connected (screwed) via a fastening means 24 to a first profile element 13 of the second supporting means (substructure) 215. The fastening means 24 (screw) penetrates through the first profile element 13 of the first supporting means (substructure) 214, the second gypsum board panel 19 of the fourth breakage-resistant composite 213, the metal sheet 18 of the fourth breakage-resistant composite 213, the first gypsum board panel 17 of the breakage-resistant composite 213, as well as the first profile element 13 of the second supporting means (substructure) 215. As a result of this as well, the stability and break-in security is further improved.

According to a general concept of this embodiment (according to FIG. 2), a respective second gypsum board panel 19 is spaced apart from the next metal sheet 18 and/or the next first gypsum board panel 17. As a result, the break-in security is improved.

Figure 3:
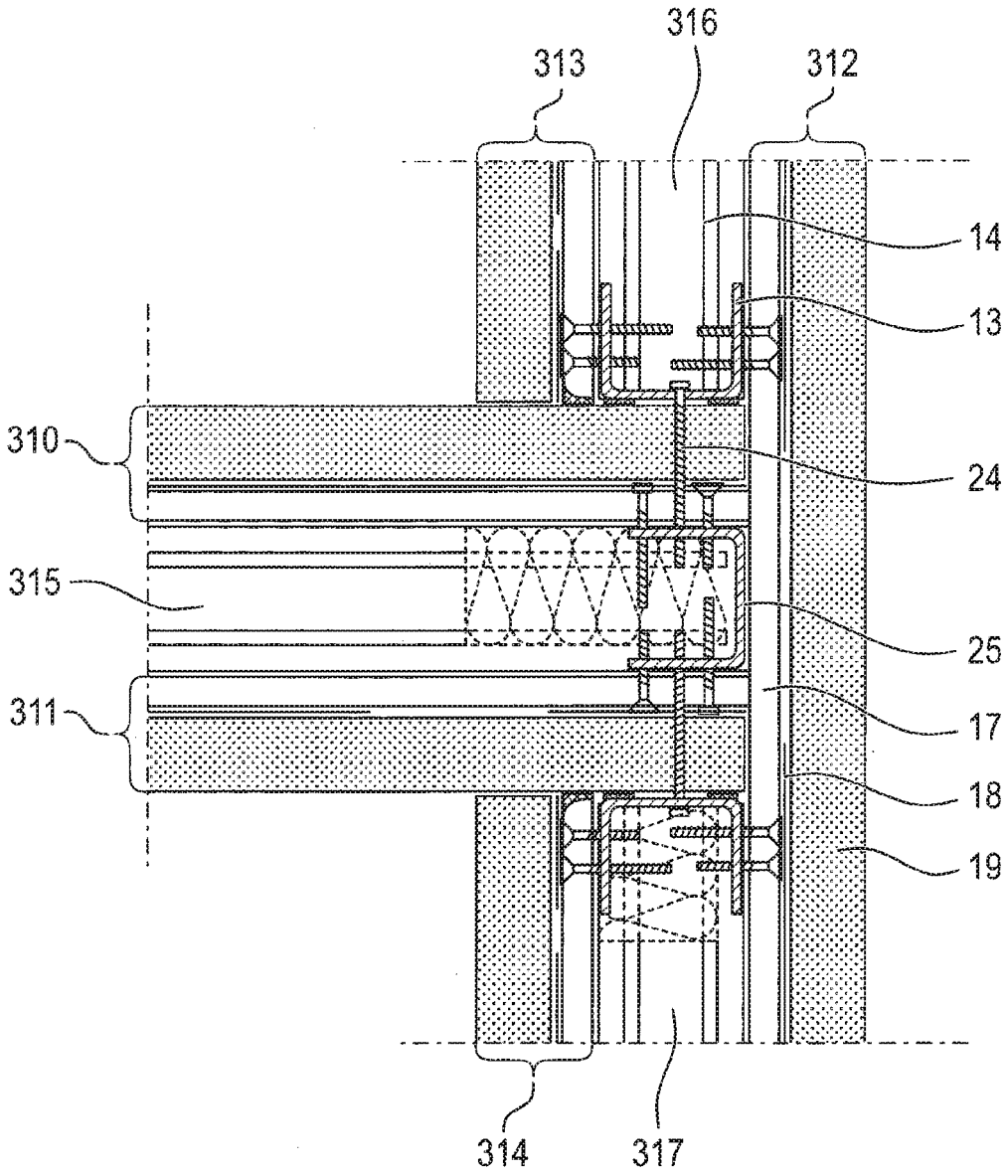
FIG. 3 shows a third cutaway of a horizontal section of a wall structure with the composite according to the invention.
Figure 4:
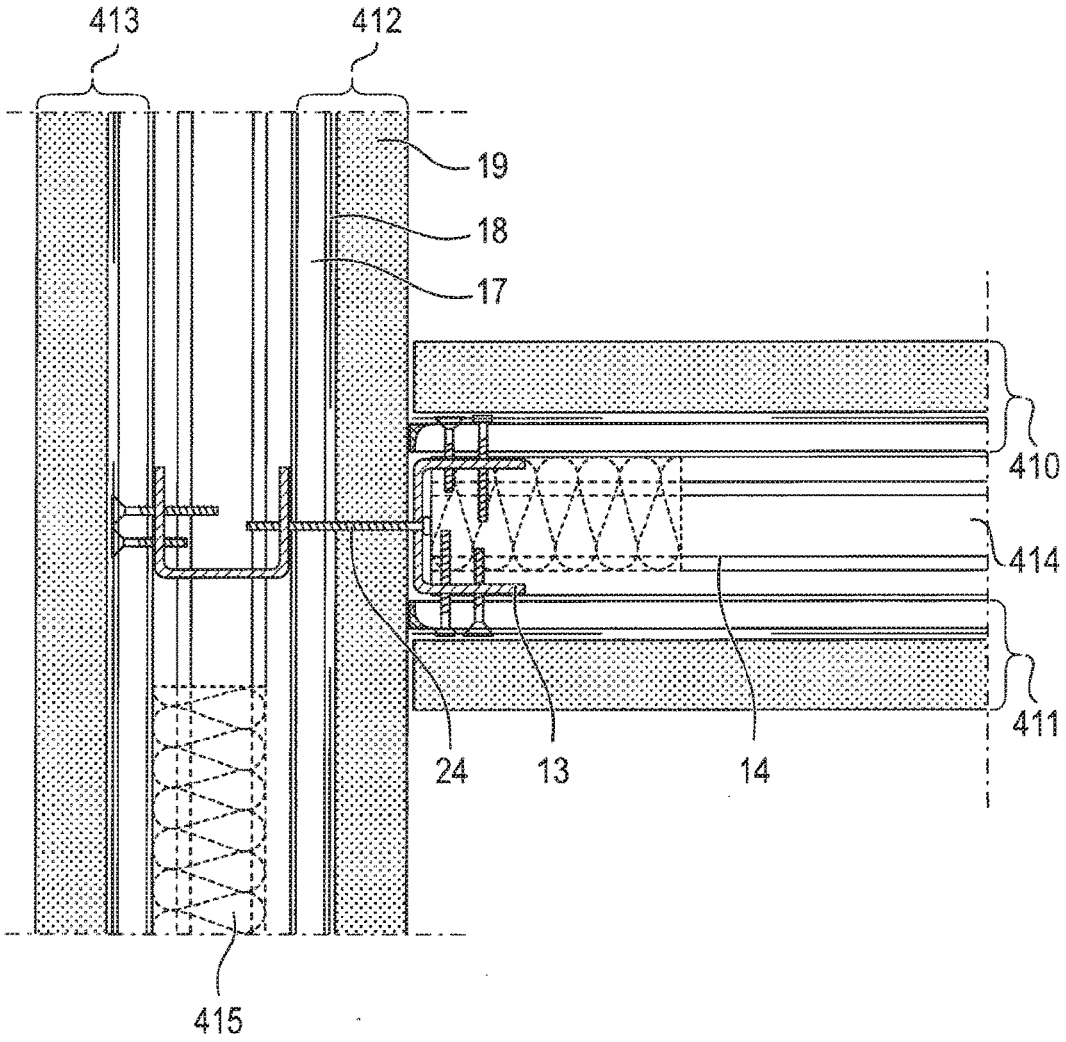
FIG. 4 shows a fourth cutaway of a horizontal section of a wall structure with the composite according to the invention.

FIGS. 3 and 4 show cutaways of a horizontal section through a T-connection of two wall segments with breakage-resistant composites according to the invention. In the alternative according to FIG. 3, a first supporting means (substructure) 315 is covered by a first composite 310 and a second composite 311. A front face 25 of the first supporting means (substructure) 315 with the breakage-resistant composites 310, 311 borders on a third breakage-resistant composite 312 and is covered by same. The first breakage-resistant composite 310 of the first supporting means (substructure) 315 borders, in turn, on front faces of a fourth breakage-resistant composite 313, which covers a second supporting means (substructure) 316. Accordingly, the second breakage-resistant composite 311 of the first supporting means (substructure) 315 borders on a fifth breakage-resistant composite 314 of a third supporting means (substructure) 317 or the front faces thereof. The unit of first supporting means (substructure) 315 and the breakage-resistant composites 310, 311 is thus dipped into the perpendicularly running wall segment in such a way that an especially secure construction is achieved that is very difficult to penetrate.

FIG. 4 shows an alternative for the implementation of a T-connection. Front faces of a first supporting means (substructure) 414 with associated first and second breakage-resistant composite 410, 411 border on a third breakage-resistant composite 412 of a second supporting means (substructure) 415. A fourth breakage-resistant composite 413 is provided on a side of the supporting means (substructure) 415 facing away from the first supporting means (substructure) 414. This alternative is especially simple in terms of its structure but is comparatively secure nonetheless.

Figure 5:
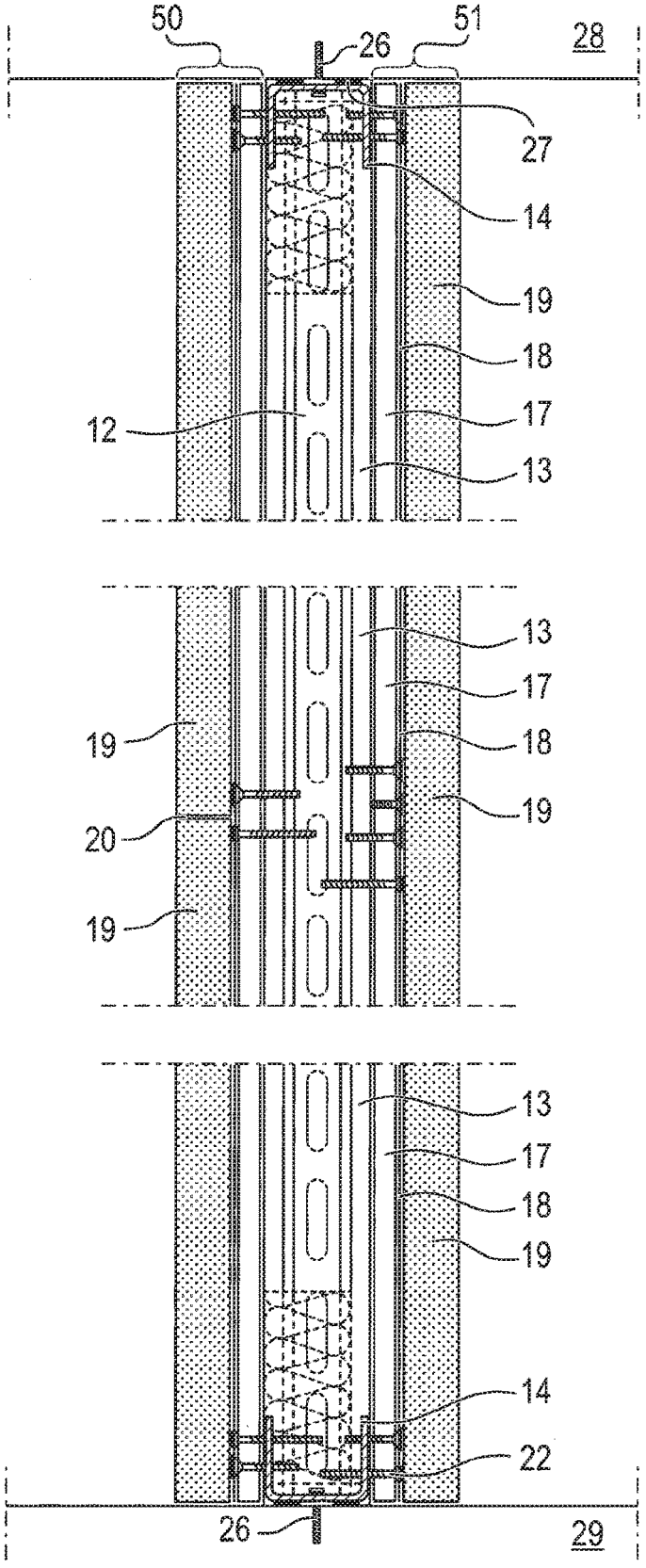
FIG. 5 shows three cutaways of a vertical section of a wall structure with the composite according to the invention.

FIG. 5 shows cutaways of a vertical section of a wall structure with breakage-resistant composites according to the invention. The supporting means (substructure) 12 is connected via a fastening means 26 (comprising a screw and/or a pin, for example) to a ceiling 28. Moreover, the supporting means (substructure) 12 is connected via a corresponding fastening means 26 to the floor 29. A partition wall sealant 27 can be provided in the region of the fastening means 26.

A joint 20 of a second gypsum board panel 19 of the first breakage-resistant composite 50 is covered by a first gypsum board panel 19 of the second composite 51. As a result, the security of the wall structure is improved.

The basic structure of a wall or of a wall system according to FIGS. 1 to 5 is as follows:

A single stud frame is provided on both sides with two-layer paneling composed of a layer of paperbound gypsum board panel and a layer of gypsum fiberboard panel. A steel sheet insert is provided between the paperbound gypsum board panel and the gypsum fiberboard panel.

The stud frame can be connected circumferentially to adjacent components. Damping substances (to meet noise and thermal protection requirements) can be installed in a wall hollow space. Expansion joints of a shell construction can be adopted in the construction of the security wall. For continuous walls, expansion joints can be required at an interval of (about) 15 m.

Edge profiles on the ground and/or ceilings and on walls can be provided on the rear side with partition wall sealant (with two ridges) or a sealing tape.

Edge profiles can be fastened to flanking components by means of suitable fastening means.

The metal sheet (steel sheet) can be arranged as plate or rolled goods (≥0.5 mm thick) horizontally or vertically between the gypsum board panel layers. Vertical joints can be arranged on studs. All joints can be arranged in an offset manner without overlapping. The screwing of the steel sheets can be done using quick-action screws.

The gypsum board panels can have dimensions of 624×600 mm. Butt joints can be arranged in an offset manner. For door stud profiles, butt joints can be omitted. For fire protection requirements, lower connecting joints can be sealed with putty material. For noise protection requirements, an acrylate or a partition wall sealant can be used, for example.

The paperbound gypsum board panel can have a thickness of 12.5 mm, 15 mm, 18 mm or 20 mm; a width of 625 mm or 1,250 mm; and a length of 2,000 mm or 2,500 mm or 2,600 mm. The raw density can be ≥1,000 kg/m$^3$.

The gypsum board panel can have a thickness of 28 mm, a width of 600 mm and a length of 624 mm. A raw density can be ≥1,500 kg/m$^3$.

It should be pointed out here that all of the parts described above are claimed as being essential to the invention alone and in any combination, particularly the details illustrated in the figures. Modifications thereof are commonplace to a person skilled in the art.

LIST OF REFERENCE SYMBOLS

10 first breakage-resistant composite
11 second breakage-resistant composite
12 supporting means (substructure)
13 first profile element
14 second profile element
15 first side of the supporting means (substructure) 12
16 second side of the supporting means (substructure) 12
17 first gypsum board panel
18 metal sheet
19 second gypsum board panel
20 joint
21 fastening means
22 fastening means
23 contact surface
24 fastening means
25 front face
26 fastening means
27 sealant
28 ceiling
29 floor
50 first breakage-resistant composite
51 second breakage-resistant composite
210 first breakage-resistant composite
211 second breakage-resistant composite
212 third breakage-resistant composite
213 fourth breakage-resistant composite
214 first breakage-resistant composite
215 second breakage-resistant composite
310 first breakage-resistant composite
311 second breakage-resistant composite
312 third breakage-resistant composite
313 fourth breakage-resistant composite
314 fifth breakage-resistant composite
315 first supporting means
316 second supporting means
410 first breakage-resistant composite
411 second breakage-resistant composite
412 third breakage-resistant composite
413 fourth breakage-resistant composite
414 first supporting means
415 second supporting means

The invention claimed is:

1. A breakage-resistant composite composed of several superposed layers, particularly as planking for a stud wall, roof or ceiling structure, wherein the composite comprises at least one first gypsum board panel in the form of a paperbound gypsum board panel, at least one metal sheet arranged on the first gypsum board panel, and at least one second gypsum board panel in the form of a gypsum fiberboard panel arranged on the metal sheet, wherein the at least one second gypsum board panel has a density being higher than a density of the first gypsum board panel and being greater than or equal to 1,500 kg/m$^3$.

2. The breakage-resistant composite as set forth in claim 1, wherein the metal sheet and at least one second gypsum board panel are adhered to one another.

3. The breakage-resistant composite as set forth in claim 1, wherein at least two second gypsum board panels are adjacently arranged on the metal sheet.

4. The breakage-resistant composite as set forth in claim 3, wherein the two second gypsum board panels are adhered to one another at their adjacent edge surfaces.

5. The breakage-resistant composite, particularly as set forth in claim 1, composed of several superposed layers, particularly as planking for a stud wall, roof or ceiling structure, wherein the composite comprises at least one first gypsum board panel, particularly in the form of a paper-bound gypsum board panel, at least one metal sheet arranged on the first gypsum board panel, and at least two second gypsum board panels, particularly in the form of a gypsum fiberboard panel, arranged on the metal sheet, wherein the at least two second gypsum plaster boards are bonded onto the metal sheet and bonded with each other at adjacent edge surfaces.

6. The breakage-resistant composite as set forth in claim 1, wherein at least two first or second gypsum board panels form a joint between them, and at least one second gypsum board panel extends over the joint and/or at least two first or second gypsum board panels form a joint between them, and at least one other second gypsum board panel extends over the joint.

7. The breakage-resistant composite as set forth in claim 1, wherein the at least one first gypsum board panel has a density of greater than or equal to 500 kg/m$^3$ and/or less than or equal to 2,000 kg/m$^3$, and/or a thickness of greater than or equal to 5 mm and/or less than or equal to 40 mm.

8. The breakage-resistant composite as set forth in claim 7, wherein the at least one first gypsum board panel has a density of greater than or equal to 1000 kg/m$^3$.

9. The breakage-resistant composite as set forth in claim 7, wherein the at least one first gypsum board panel has a density of less than or equal to 1500 kg/m$^3$.

10. The breakage-resistant composite as set forth in claim 7, wherein the at least one first gypsum board panel has a thickness of greater than or equal to 10 mm.

11. The breakage-resistant composite as set forth in claim 7, wherein the at least one first gypsum board panel has a thickness of less than or equal to 30 mm.

12. The breakage-resistant composite as set forth in claim 11, wherein the at least one first gypsum board panel has a thickness of less than or equal to 20 mm.

13. The breakage-resistant composite as set forth in claim 1, wherein the at least one second gypsum board panel has a density of less than or equal to 3,000 kg/m$^3$, and/or a thickness of greater than or equal to 20 mm, and/or less than or equal to 50 mm.

14. The breakage-resistant composite as set forth in claim 13, wherein the at least one second gypsum board panel has a density of less than or equal to 2,000 kg/m$^3$.

15. The breakage-resistant composite as set forth in claim 13, wherein the at least one second gypsum board panel has a thickness of greater than or equal to 28 mm.

16. The breakage-resistant composite as set forth in claim 13, wherein the at least one second gypsum board panel has a thickness of less than or equal to 40 mm.

17. The breakage-resistant composite as set forth in claim 1, wherein the at least one second gypsum board panel has a greater thickness than the at least one first gypsum board panel.

18. The breakage-resistant composite as set forth in claim 1, wherein the metal sheet is a (particularly galvanized) steel sheet and/or has a thickness of greater than or equal to 0.3 mm.

19. The breakage-resistant composite as set forth in claim 18, wherein the metal sheet has a thickness of greater than or equal to 0.5 mm.

20. The breakage-resistant composite as set forth in claim 18, wherein the metal sheet has a thickness of less than or equal to 0.8 mm.

21. The breakage-resistant composite as set forth in claim 1, wherein an adhesive for adhering at least one second gypsum board panel to the at least one metal sheet is an elastic adhesive and/or an adhesive for adhering adjacent contact surfaces of two second gypsum board panels is a joint adhesive, particularly a polyurethane-based joint adhesive.

22. A stud wall, roof or ceiling structure, comprising at least one supporting means, particularly at least one profile element, wherein at least one breakage-resistant composite as set forth in claim 1 is arranged on a first side of the supporting means, and wherein the at least one first gypsum board panel of the breakage-resistant composite is arranged on the supporting means.

23. The stud wall, roof or ceiling structure as set forth in claim 22, wherein at least one other breakage-resistant composite is arranged on a second side of the supporting means, the at least one first gypsum board panel of the at least one other breakage-resistant composite faces toward is arranged on the supporting means.

24. A method of safeguarding against a person's breaking in or breaking out, comprising the steps of:

a) providing a stud wall, roof or ceiling structure with at least one supporting means; and b) arranging on a first side of said supporting means at least one breakage-resistant composite, wherein the composite comprises at least one first gypsum board panel in the form of a paperbound gypsum board panel, at least one metal sheet arranged on the first gypsum board panel, and at least one second gypsum board panel in the form of a gypsum fiberboard panel arranged on the metal sheet, wherein the at least one second gypsum board panel has a density being higher than a density of the first gypsum board panel and being greater than or equal to 1,500 kg/m$^3$.

25. The method of claim 24, wherein the at least one supporting means comprises at least one profile element.

26. The method of claim 24, wherein the at least one first gypsum board panel faces toward is arranged on the supporting means.

* * * * *